US006199417B1

(12) United States Patent
Palzer et al.

(10) Patent No.: US 6,199,417 B1
(45) Date of Patent: Mar. 13, 2001

(54) TENSION CONTROL METHOD FOR A ROLLING STOCK SECTION

(75) Inventors: Otmar Palzer, Jülich; Karl Keller; Karl-Heinz Balve, both of Hilchenbach, all of (DE); Miroslav Polok, Trinec (CZ)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/421,666

(22) Filed: Oct. 20, 1999

(30) Foreign Application Priority Data

Oct. 24, 1998 (DE) ..... 198 49 068

(51) Int. Cl.[7] ..... B21B 37/48
(52) U.S. Cl. ..... 72/8.6; 72/11.4; 72/14.5
(58) Field of Search ..... 72/8.6, 11.4, 12.3, 72/205, 10.1, 10.4, 14.4, 14.5

(56) References Cited

U.S. PATENT DOCUMENTS 2,569,264 9/1951 Stone et al. .
3,961,510 6/1976 Kovacs .
4,674,310 6/1987 Ginzburg .
5,546,779 * 8/1996 Ginzburg ..... 72/11.4
5,701,774 * 12/1997 Imanari et al. ..... 72/205
5,809,817 * 9/1998 Ginzburg ..... 72/205

FOREIGN PATENT DOCUMENTS 1427893 11/1968 (DE) .
2816091 4/1987 (DE) .

* cited by examiner

*Primary Examiner*—Ed Tolan
(74) *Attorney, Agent, or Firm*—Friedrich Kueffner

(57) ABSTRACT

A tension control method for a rolling stock section located between a front roll stand and a rear roll stand of a rolling train, wherein a tensioning element with an actual adjusting force is adjusted relative to the rolling stock section, so that the rolling stock section is deflected by the tensioning element by an actual deflection; the actual adjusting force and the actual deflection are determined; and a tension existing between the front roll stand and the rear roll stand in the rolling stock section is adjusted such that the actual adjusting force approaches a desired adjusting force and/or the actual deflection approaches a desired deflection.

6 Claims, 1 Drawing Sheet

TENSION CONTROL METHOD FOR A ROLLING STOCK SECTION

BACKGROUND OF THE INVENTION

1. Field of the Invention

The present invention relates to a tension control method for a rolling stock section located between a front roll stand and a rear roll stand of a rolling train.

2. Description of the Related Art

In accordance with the prior art, slender rolling stock, such as bar steel and wire, is rolled in continuous rolling trains. When in these trains the rates of rotation of successive roll stands do not correspond to the continuity equation which is determined by the constant mass flow, tension or compression build up between the successive roll stands.

Tension and compression in the rolling stock have a negative influence on the cross-section tolerances, particularly the section width. Moreover, compression in the rolling stock leads to instabilities which produce so-called fluttering. In an extreme case, compression in the rolling stock may even lead to material ruptures and interruptions of the operation.

In order to achieve good finishing tolerances and to guaranty a safe rolling process, an efficient tension control is required.

In accordance with the prior art, primarily two control types are used for tension control, i.e., the so-called flow stoppage method and the looping method. For realizing both methods, a minimum distance between stands is required. When the distances between stands are too small, only a manual method of tension control is available in the prior art. By applying an impact or pressure on the rolling stock, the rolling train operator attempts to estimate the tension or compression present in the rolling stock based on his experience. This method of operation is subjective and very imprecise and also unreliable. Moreover, this method can only be carried out in certain time intervals. A control of the tension is not possible using this method.

SUMMARY OF THE INVENTION

It is the primary object of the present invention to provide a tension control method which makes possible a reliable tension control even when the distances between stands are small and the rolling speeds are high.

In accordance with the present invention

- a tensioning element with an actual adjusting force is adjusted relative to the rolling stock section, so that the rolling stock section is deflected by the tensioning element by an actual deflection;
- the actual adjusting force and the actual deflection are determined; and
- a tension existing between the front roll stand and the rear roll stand in the rolling stock section is adjusted such that the actual adjusting force approaches a desired adjusting force and/or the actual deflection approaches a desired deflection.

When the tensioning element is adjusted relative to the rolling stock section by means of a hydraulic pressure cylinder, a determination of the actual adjusting force and the actual deflection are possible in a particularly simple manner. This is because hydraulic pressure cylinders usually include a position pick-up which is mounted in or on the pressure cylinder, wherein this pick-up is capable of determining the travel distance of the pressure cylinder. The actual adjusting force results directly from the work pressure of the pressure cylinder in connection with the piston cross-section of the pressure cylinder.

The tension control method can be realized in a particularly simple manner if one of the two actual values is kept constant equal to the corresponding desired value and only the other actual value is variable. In this connection, the actual adjusting force or the actual deflection can be kept constant alternatively.

It is particularly simple to keep the actual adjusting force constant if the hydraulic pressure cylinder is subjected to a work pressure from a pressure application device which is subjected to an operational pressure, if the operational pressure includes at least one minimum pressure and if the work pressure is smaller than the minimum pressure.

If the desired adjusting force is selected in such a way that the resulting desired deflection differs from zero, it is possible to detect and correct by means of the tensioning element upward deviations of the tension prevailing in the rolling stock section as well as downward deviations of the tension prevailing in the rolling stock section.

The tension control method can become a self-learning method if the following features are met:

- the rolling stock includes a rolling stock end;
- a holding element is arranged in front of the front roll stand;
- a continuous moment applied by the rear roll stand is determined after the rolling stock end has left the holding element and before the rolling stock end leaves the front roll stand;
- a free moment applied by the rear roll stand is determined after the rolling stock end has left the front roll stand and before the rolling stock end leaves the rear roll stand;
- the tension actually prevailing in the rolling stock section before the rolling stock end leaves the front roll stand is determined from a comparison of the free moment and the continuous moment; and
- correction values for the desired adjusting force and/or the desired deflection are determined from the actually prevailing tension.

When the free moment and the continuous moment are each determined several times and mean values of the free moment and the continuous moment are formed for comparing the free moment and the continuous moment, the influence of problems during rolling will be low.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
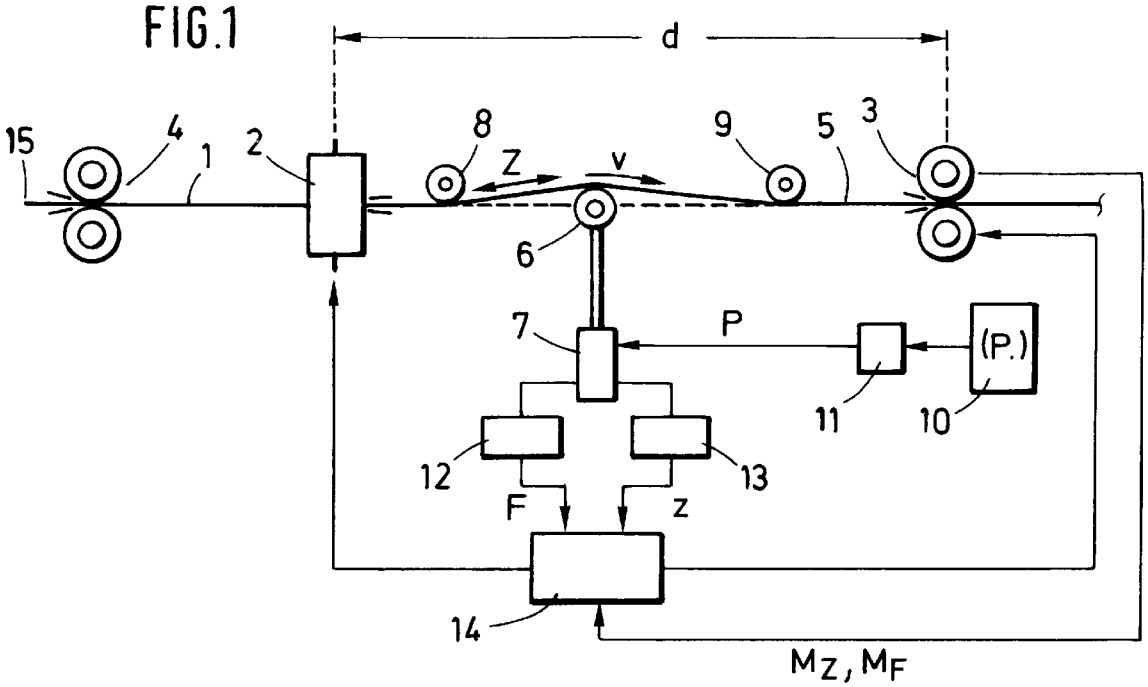
FIG. 1 is a schematic illustration of a multiple-stand rolling train.

As illustrated in FIG. 1, a rolling stock 1 is rolled in a multiple-stand rolling train. The rolling train includes at least a front roll stand 2 and a rear roll stand 3. A holding element 4 is arranged in front of the front roll stand 2.

In accordance with the illustrated embodiment, the holding element 4 is also constructed as a roll stand. However, the holding element could also be a driver or another holding unit.

A rolling stock section of the rolling stock 1 is located between the roll stands 2 and 3. A tension Z prevails in the rolling stock section 5. The tension Z in the rolling stock section 5 is adjusted by means of the roll stands 2,3.

In accordance with the illustrated embodiment, the holding element 4 and the rear roll stand 3 are constructed as vertical stands, while the front roll stand 2 is constructed as a horizontal stand. Consequently, the rolling train is a rolling train for slender rolling stock 1, for example, bar steel or wire. In principle, however, the tension control method could also be used in a rolling train for strip-shaped rolling stock 1.

A tensioning element 6 is arranged between the roll stands 2 and 3. In the illustrated embodiment, the tensioning element 6 is a roller. The tensioning element is adjusted by means of an adjusting element 7 with an actual adjusting force F against the rolling stock section 5. This causes the rolling stock section 5 to be deflected from its ideal line, illustrated in broken lines, by an actual deflection z. In order to ensure a problem-free guidance of the rolling stock 1 in the roll stands 2,3, counter rollers 8,9 are arranged between the tensioning elements 6 and the roll stands 2,3.

In accordance with the illustrated embodiment, the adjusting element 7 is a hydraulic pressure cylinder. As is conventional, the pressure cylinder 7 includes a position sensor. As a result, the actual deflection z can be determined from the directly measurable travel distance of the pressure cylinder 7.

A work pressure p acts from a pressure application device 10 on the pressure cylinder 7. The pressure application device 10 is subjected to an operational pressure $p_o$. The operational pressure $p_o$ is variable, but has at least a minimum pressure $p_{min}$. The work pressure p is adjusted by means of a pressure reducing valve 11 which is arranged between the pressure application device 10 and the adjusting element 7. The work pressure p is preferably smaller than the minimum pressure $p_{min}$.

The pressure cylinder has a piston surface A. The actual adjusting force F results as the product of the easily measurable work pressure p and the piston surface A of the pressure cylinder 7.

In the illustrated embodiment, by an appropriate adjustment of the work pressure p by means of the pressure reducing valve 11, the actual adjusting force F is kept constant equal to a desired adjusting force F*. Consequently, only the actual deflection z varies.

The actual deflection z, and for safety's sake also the actual adjusting force F, are measured by appropriate sensors 12, 13 and supplied to an evaluating unit 14. The evaluating unit 14 compares the actual deflection z to the desired deflection z*. If the actual deflection z is greater than the desired deflection z*, the tension Z prevailing in the rolling stock section 5 is too low. In that case, by appropriately controlling the roll stands 2 and/or 3, the tension Z is increased so that the actual deflection z approaches the desired deflection z*. If, vice-versa, the actual deflection z is smaller than the desired deflection z*, the tension Z is reduced.

The tension Z prevailing in the rolling stock section 5 is to be influenced as little as possible by the tensioning element 6. Accordingly, the desired adjusting force F* is selected as low as possible. On the other hand, the desired adjusting force F* is selected in such a way that the desired deflection z* caused by the desired adjusting force F* differs from zero.

In accordance with the illustrated embodiment, the actual adjusting force F is kept constant and equal to the desired adjusting force F*, so that only the actual deflection z is variable. However, it is conversely also possible to keep the actual deflection z constant and equal to the desired deflection z*, so that only the actual adjusting force F is variable. Such position controls are generally known in pressure cylinders 7. However, it would also be possible to select both values F, z to be variable. However, in that case, the control algorithm would be more complicated.

Figure 2:
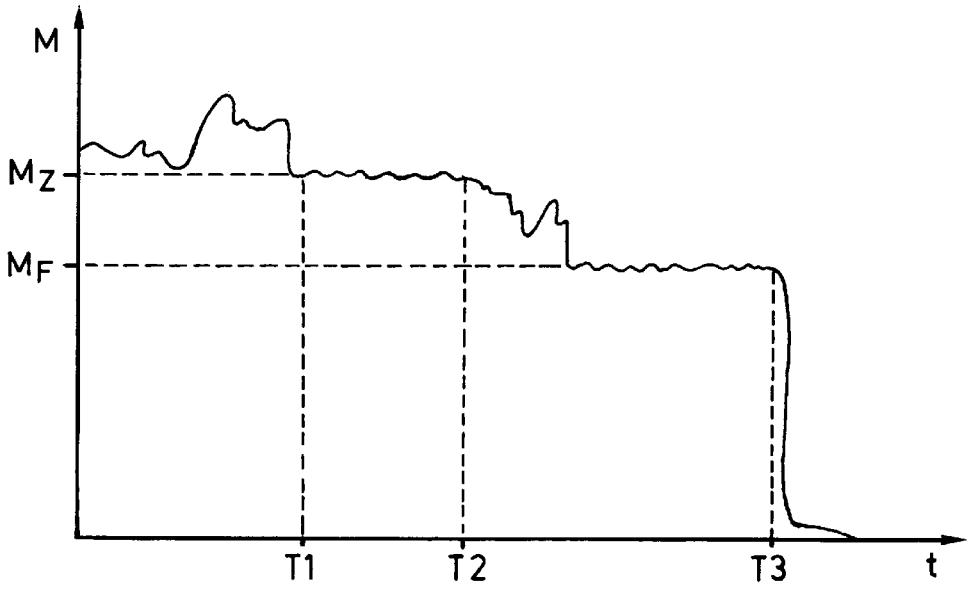
FIG. 2 is a moment/time diagram.

The rolling stock 1 has a rolling stock end 15. In order to be able to determine correction values for the desired adjusting force F* and/or the desired deflection z*, the following method is used:

At a point in time T1, the rolling stock end 15 leaves the holding element 4, as seen in FIG. 2. After this point in time T1, the drive moment M applied by the rear roll stand 3, called continuous moment $M_k$ above and in the following, is measured several times and an average value of the measured continuous moments $M_k$ is formed. This measuring of the moments and forming of average values is concluded before the rolling stock end 15 travels at a point in time T2 out of the front roll stand 2.

After the rolling stock end 15 leaves the front roll stand 2, a drive moment M applied by the rear roll stand 3, called free moment $M_F$ in the following, is measured and an average value is formed from the measured free moments $M_F$. The measuring of the free moments $M_F$ and the corresponding forming of average values must be concluded prior to a point in time T3 at which the rolling stock end 15 travels out of the rear roll stand 3.

By comparing the free moment $M_F$ and the continuous moment $M_k$ or the corresponding average values, the tension Z is determined which actually prevailed in the rolling stock section 5 before the rolling stock end 15 leaves the front roll stand 2. The correction values can then be determined from the actual prevailing tension Z.

For example, the points in time T1, T2 and T3 can be determined on the basis of points in time at which the moments M applied by the holding element 4, the front roll stand 2 and the rear roll stand 3 drop to zero.

The tension control method according to the present invention can especially also be used when the distance d between the roll stands 2 and 3 is small, i.e., only, for example, one to two meters, although the rolling stock section 5 of the rolling stock 1 may travel at a speed v of 15–20 m/s and even more in individual cases. In addition, the investment costs are lower than the investment costs for a looping control.

The tension control method according to the present invention can be used in roughing trains for slender rolling stock as well as in intermediate and finishing trains. Existing rolling trains can also easily be retrofitted to carry out the tension control method.

We claim:

1. A tension control method for a rolling stock section located between a front roll stand and a rear roll stand of a rolling train, the method comprising adjusting a tensioning element with an actual adjusting force against the rolling stock section, so that the rolling stock section is deflected by the tensioning element by an actual deflection, keeping the actual adjusting force constant and equal to a desired adjusting force and measuring the actual deflection, comparing the actual deflection with the desired deflection, and based on a result of comparing the actual and the desired deflections, controlling at least one of the front roll stand and the rear roll stand such that the actual deflection approaches a desired deflection.

2. The tension control method according to claim 1, comprising adjusting the tensioning element against the rolling stock section using a hydraulic pressure cylinder.

3. The tension control method according to claim 2, comprising applying a work pressure to the hydraulic cylinder using a pressure application device subjected to an operational pressure, wherein the operational pressure has at least a minimum pressure and the work pressure is smaller than the minimum pressure.

4. The tension control method according to claim 1, comprising selecting the desired adjusting force such that the resulting desired deflection differs from zero.

5. The tension control method according to claim 1, wherein the rolling stock section has a rolling stock end, and wherein a holding element is arranged in front of the front roll stand, the method further comprising measuring a continuous moment applied by the rear roll stand after the rolling stock end has left the holding element and before the rolling stock end has left the front roll stand, measuring a free moment applied by the rear roll stand after the rolling stock end has left the front roll stand and before the rolling stock end has left the rear roll stand, determining an actually prevailing tension in the rolling stock section before the rolling stock end leaves the front roll stand by comparing the free moment and the continuous moment, and determining correction values for at least one of the desired adjusting force and the desired deflection from the actually prevailing tension.

6. The tension control method according to claim 5, comprising measuring the free moment and the continuous moment several times and forming average values of the free moments and the continuous moments for comparing the free moments and the continuous moments.

* * * * *